United States Patent [19]

Jaco et al.

[11] Patent Number: 4,927,698

[45] Date of Patent: May 22, 1990

[54] PUCKER AND SHRINK RESISTANT FLAME RETARDANT FABRIC FORMED OF CORESPUN YARNS

[75] Inventors: Pamela J. Jaco, Rock Hill; Thomas W. Tolbert, Fort Mill, both of S.C.

[73] Assignee: Springs Industries, Inc., Fort Mill, S.C.

[21] Appl. No.: 324,266

[22] Filed: Mar. 15, 1989

[51] Int. Cl.[5] ..... B32B 27/14

[52] U.S. Cl. ..... 428/198; 428/260; 428/262; 428/264; 428/265; 428/266; 428/267; 428/268; 428/272; 428/273; 428/274; 428/373; 428/377

[58] Field of Search ..... 428/264, 266, 267, 268, 428/377, 198, 260, 262, 265, 272, 273, 274, 373

[56] References Cited

U.S. PATENT DOCUMENTS

| | | | |
|---|---|---|---|
| 3,729,920 | 5/1973 | Sayers et al. | 57/144 |
| 3,913,309 | 10/1975 | Chiarotto | 57/144 |
| 4,541,231 | 9/1985 | Graham, jr. et al. | 57/12 |
| 4,756,714 | 7/1988 | Hendrix et al. | 8/111.6 |

*Primary Examiner*—Marion C. McCamish

*Attorney, Agent, or Firm*—Bell, Seltzer, Park & Gibson

[57] ABSTRACT

A fabric formed of yarns having a core formed of fire-resistant filaments and a sheath formed of staple fibers and a cured, crosslinked composition applied to one surface of the fabric is provided. The composition comprises a first crosslinkable resin having an affinity for the fire-resistant filament core and a second crosslinkable resin having an affinity for the staple fiber sheath and for the first crosslinkable resin. The fabric because of the composition is pucker and shrink resistant, and the tensile strength and flexibility of the yarns and the aesthetic appeal of the fabric are maintained when the fabric is washed repeatedly.

14 Claims, 3 Drawing Sheets

PUCKER AND SHRINK RESISTANT FLAME RETARDANT FABRIC FORMED OF CORESPUN YARNS

FIELD AND BACKGROUND OF THE INVENTION

This invention relates to a fabric formed of corespun yarns having a cured crosslinked composition applied thereto which imparts pucker and shrink resistance properties to the fabric. The invention also relates to a method for imparting these properties to a fabric.

Flame resistance is an important characteristic in textile fabrics used in certain applications, for example, bedroom articles such as mattress ticking, pillow ticking, and mattress covers, upholstery, floor coverings and wall coverings for office buildings. Many common textile fabrics formed of natural and synthetic yarns are flammable, and manufacturers have thus sought to produce fabrics having the aesthetic appeal of these textile fabrics but also fabrics having superior flame resistant properties.

It is known to treat or coat conventional nonflame retardant textile fabrics with flame retardant chemicals. These treated fabrics, however, have limited usefulness inasmuch as the flame retardant chemicals adversely affect the aesthetic properties of the fabrics, and moreover present toxicity problems.

An alternative is to form fabrics from flame resistant fibers such as Kevlar ®, Nomex ®, polybenzimidazole and the like. These fibers, however, also have undesirable aesthetic properties in that the hand of these fabrics is typically coarse, the drapability of the fabrics is poor, and the ability to dye the fabrics is limited.

The present invention is based on fabrics formed from corespun yarns having a fire-resistant core filament and a natural or synthetic fiber sheath surrounding the core. Since the sheath surrounds and completely covers the core, the outer surface of the yarn has the desired appearance and general characteristics of the sheath fibers, and the inner core provides the flame resistance properties to the yarn. Thus, fabrics formed from corespun yarns provide excellent flame retardant properties coupled with good aesthetic properties of dyeability, hand, drapability and the like. It has been found, however, that these fabrics do not perform well when laundered. More particularly, fabrics formed from corespun yarns, tend to pucker and shrink when washed thus adversely affecting the aesthetic appeal of the fabric. This puckering and shrinkage is thought to be caused by interfiber slippage wherein the sheath fiber shrinks and the core filament shifts and sometimes escapes from the sheath.

It is conventional to improve the shrink resistance of a fabric by treating it with a durable press finishing agent. Many of the durable press treatment processes used commercially employ as the finishing agent a resin based on formaldehyde. These formaldehyde-based resins, however, have undesirable side effects such as increased toxicity, increased flammability and reduced fabric strength particularly if methylol derivative resins are used. Additionally, such durable press treatments typically are not designed for application to corespun yarns.

SUMMARY OF THE INVENTION

The treated fabric of the present invention advantageously is highly resistant to puckering and shrinkage even with repeated laundering. Moreover, the above-noted side effects of the prior art are eliminated. The treated fabric is flame resistant and the strength and flexibility of the fabric are maintained. The fabric of the present invention is formed from corespun yarns having a core formed of fire-resistant filaments and a sheath formed of staple fibers. A crosslinkable composition is applied to the fabric and cured to impart pucker and shrink resistance to the fabric. The crosslinkable composition comprises a first crosslinkable resin having an affinity for the fire-resistant filament core and a second crosslinkable resin having an affinity for the staple fiber sheath and for the first crosslinkable resin.

The present invention also provides a method of producing a pucker and shrink resistant textile fabric formed of corespun yarns which includes applying the crosslinkable composition to the fabric and curing the composition to crosslink the first and second crosslinkable resins.

BRIEF DESCRIPTION OF THE DRAWINGS

Some of the features and advantages of the invention having been stated, other will appear as the description proceeds, when considered in conjunction with the accompanying drawings, in which.

DETAILED DESCRIPTION OF THE INVENTION

The present invention will be described more fully hereinafter with reference to the accompanying drawings, in which preferred embodiments of the invention are shown. This invention can, however, be embodied in many different forms and should not be construed as limited to the embodiments set forth herein; rather, applicants provide these embodiments so that this disclosure will be thorough and complete, and will fully convey the scope of the invention to those skilled in the art.

Figure 1:
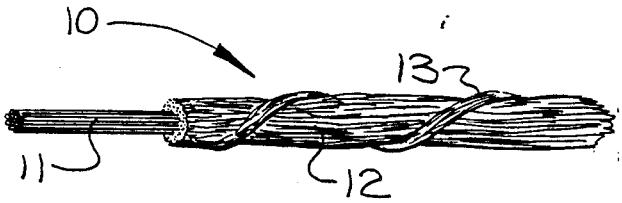
FIG. 1 is a greatly enlarged view of a fragment of a corespun yarn having a core filament/staple sheath construction.

Referring to FIG. 1, the fabrics of the present invention are woven from corespun yarns 10, comprising a core 11 of fire-resistant filaments and a sheath 12 of staple fibers. The fire-resistant filaments are typically dimensionally stable, namely the filaments do not significantly shrink on laundering particularly as compared to the sheath fibers which are shrinkable. Exemplary fire-resistant and dimensionally stable core fibers may include fibers of glass, various metals, silica, ceramic, Kevlar®, Nomex® and polybenzimidazole. The core also may be of a double core construction wherein a combination of these fire-resistant fibers are used. The shrinkable staple fibers of the sheath surrounding the core may be fibers of either natural or synthetic material such as cotton, rayon, wool, nylon, acrylic, modacrylic, polyester, acetate or blends of these fibers.

The yarns of these fabrics may be of a corespun construction and are formed by suitable apparatus such as ring spinning or preferably using a Murata air jet spinning apparatus. Airjet spun yarns, the production of which are described, for example in co-pending, commonly assigned U.S. Ser. No. 07/318,239, filed on Mar. 3, 1989, are characterized by having the majority of its fibers extending parallel to the yarn axis, with certain fibers intermittently extending out of the fiber bundle and wrapped or twisted about the other fibers to bind the fibers together. Ringspun yarns are characterized by having its fibers arranged substantially uniformly in a helical arrangement, and the fibers are held in this arrangement by the twist of the yarns.

The corespun yarns may be woven into a fabric having various known weave patterns such as plain weave, sateen weave and twill weave. The yarns may also be used to form various knitted structures such as tricot and jersey knits and stitch-bonded structures such as Malicot® or Malimo® structures. The resulting fabrics formed from these yarns are useful for such flame resistant textile articles as mattress and pillow ticking, mattress and pillow covers, furniture upholstery, wallcoverings, drapery, tenting, awnings, field fire shelters, sleeping bag covers, protective apparel and the like.

It has been discovered that fabrics formed of corespun yarns as described above exhibit a peculiar and unusual shrinkage behavior when subjected to repeated washing which has rendered the fabrics unsuited for use in many applications, particularly because of the reduced aesthetics of the fabric. Specifically, depending on the fabric construction, the shrinkage of the yarns may produce various effects, some of which are illustrated in the drawings and description below. This is particularly a problem when the fabric has long floats such as in a sateen weave. This shrinkage behavior in general is unlike anything observed in fabrics formed from conventional yarns.

Figure 2:
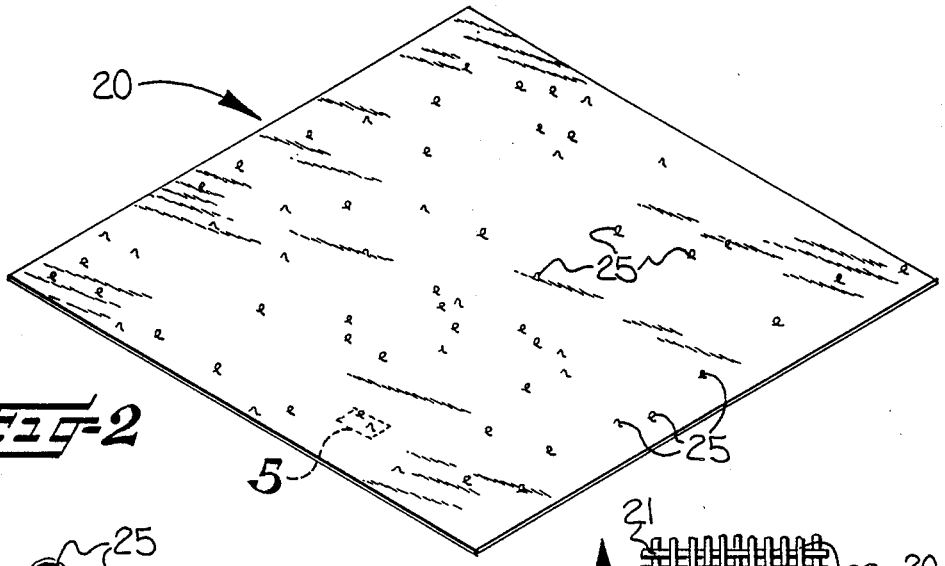
FIG. 2 is an isometric view of an untreated fabric of a sateen weave construction formed of corespun yarns, and illustrating the undesirable puckered appearance and random loops which occur after repeated washing.
Figure 5:
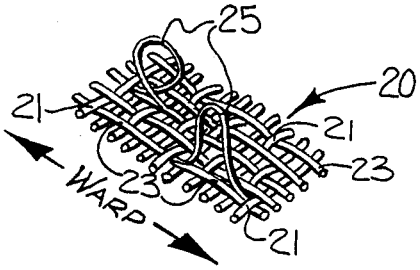
FIG. 5 is an enlarged view of the yarns of untreated fabric identified as 5 in FIG. 2 and illustrating the shifting of the yarns to form the undesirable puckers and random loops.
Figure 4:
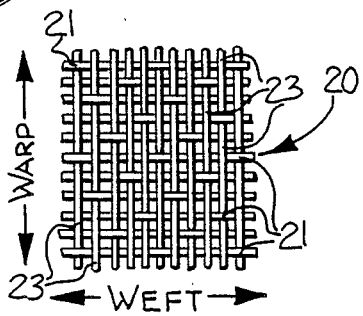
FIG. 4 is an enlarged view of the treated fabric identified as 4 in FIG. 3 and illustrating the sateen weave construction thereof.

FIG. 2 illustrates a particularly extreme manifestation of this problem where the fabric is of a sateen weave construction. After washing, the result is a series of puckers and unpleasant-looking random loops 25 of the core as shown in FIG. 5 protruding from the surface of the fabric. A conventional sateen weave fabric is characterized by a series of warpwise floats as shown in FIG. 4. The undesirable loops 25 ruin the hand of the fabric. Also many of the loops break, which may cause the fabric to become abrasive and irritating to the skin. Additionally, the exposed loops or broken loops may give the fabric a shiny appearance at random positions particularly if the core filaments are fiberglass. This is the result of the fiberglass reflecting light differently from light striking the remainder of the fabric. The undesirable puckering and loops are apparently caused by the fabric shrinking in overall dimension, with the sheath fibers also retracting from around the core so as to expose the core filaments. The core filaments thus escape from the yarn bundle and form loops 25.

Figure 3:
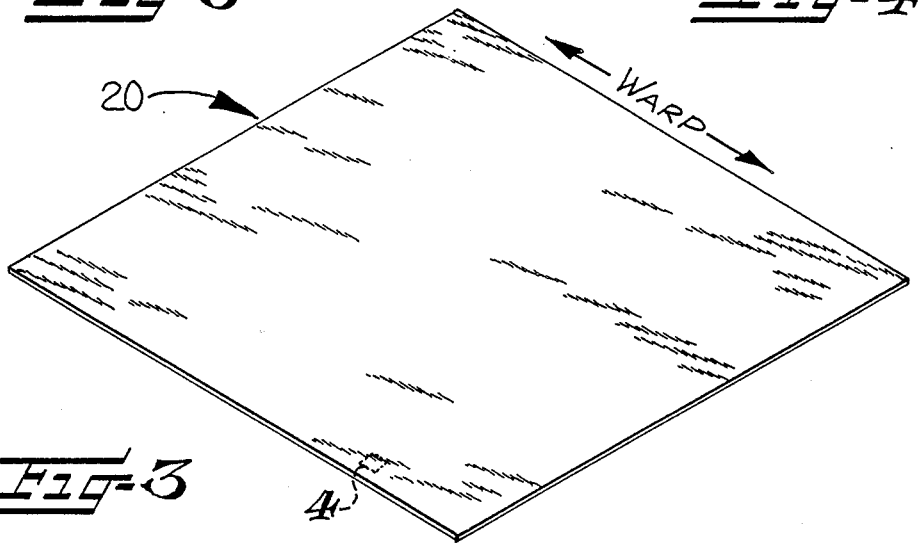
FIG. 3 is an isometric view of the fabric of FIG. 2 which has been treated in accordance with the present invention and illustrating its resistance to puckering or shrinkage.

FIG. 3 illustrates the results achieved in accordance with the present invention. The same fabric as in FIG. 2 is treated and cured as described more fully hereinafter, and is subjected to the same washing conditions. It will be noted that no loops are seen on the fabric.

Figure 6:
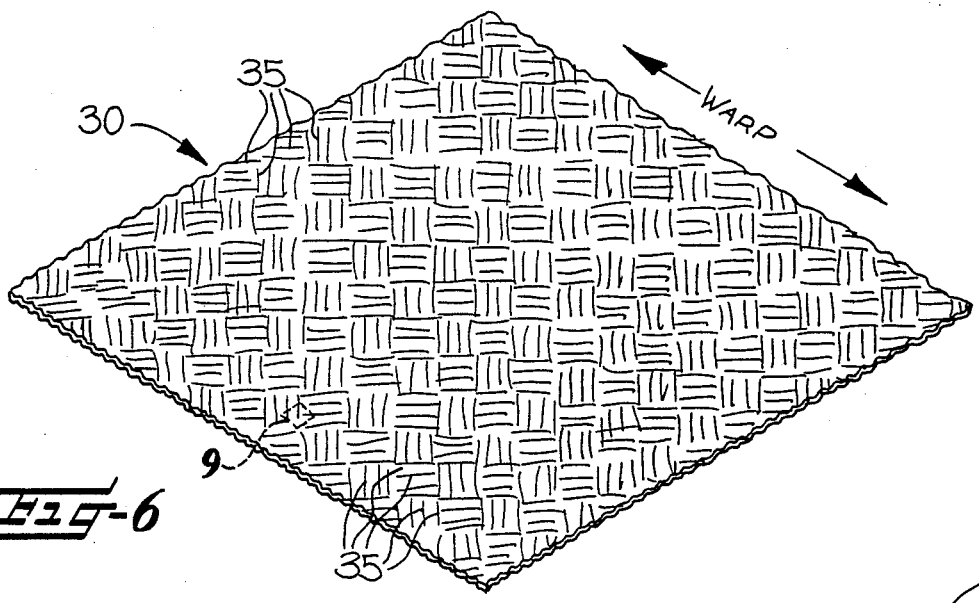
FIG. 6 is an isometric view of an untreated fabric of a plain weave construction formed of corespun yarns and illustrating an undesirable herringbone appearance which occurs after repeated washing.
Figure 8:
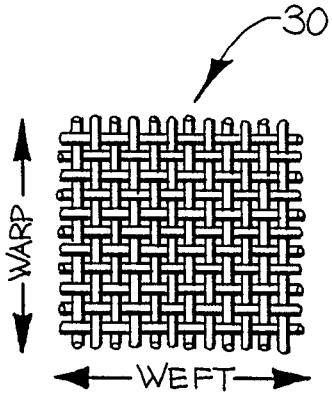
FIG. 8 is an enlarged view of the yarns of the treated fabric identified as 8 in FIG. 7 illustrating the plain weave construction thereof.
Figure 9:
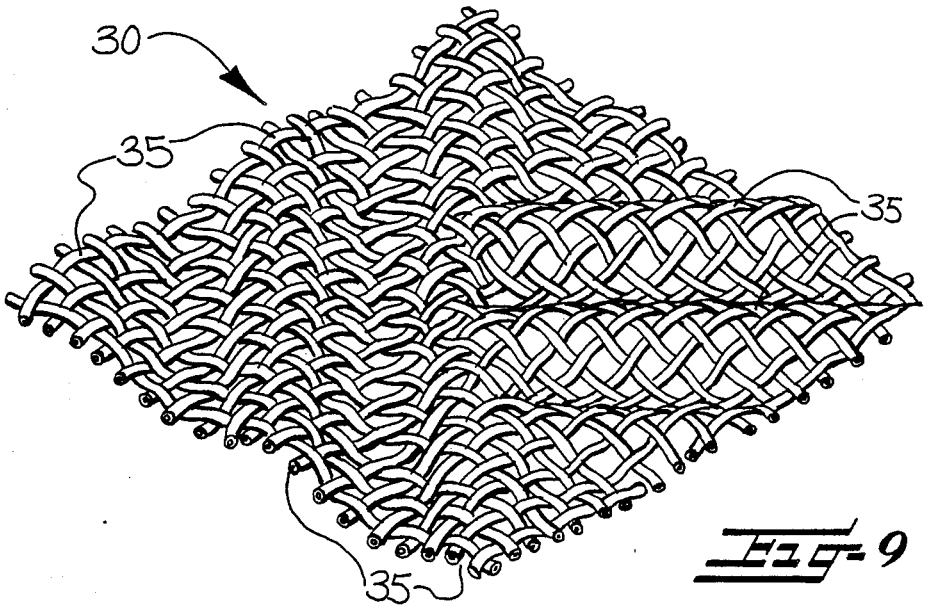
FIG. 9 is an enlarged isometric view of the yarns of the untreated woven fabric of FIG. 6 illustrating the puckering of the fabric.

FIGS. 6 and 9 illustrate another more general manifestation of the problem where the fabric is of a plain weave construction as shown in FIG. 8. After washing, the result is a series of unpleasant looking waves and puckers and some loops on the surface of the fabric giving it a herringbone appearance. The herringbone appearance which also ruins the hand of the fabric is apparently caused by the fabric shrinking in overall dimension, although not as much as the sateen weave example.

Figure 7:
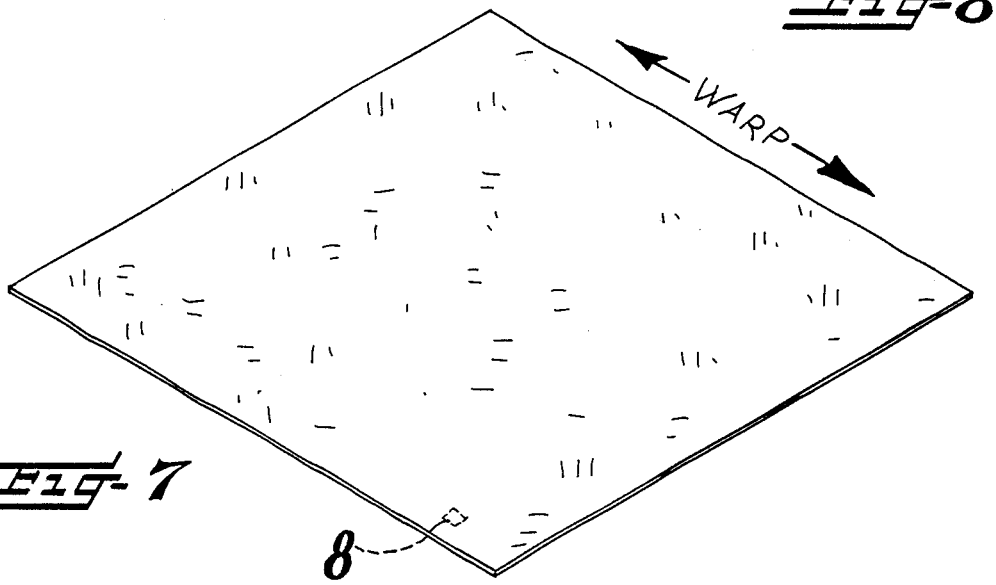
FIG. 7 is an isometric view of the fabric of FIG. 6 which has been treated in accordance with the present invention and illustrating its resistance to puckering or shrinkage.

FIG. 7 illustrates the results achieved in accordance with the present invention. The same fabric as used in FIG. 6 is treated and cured with the below-described composition and subjected to the same washing conditions. It will be noted that the puckers have been substantially reduced as seen on the fabric in FIG. 7.

Figure 10:
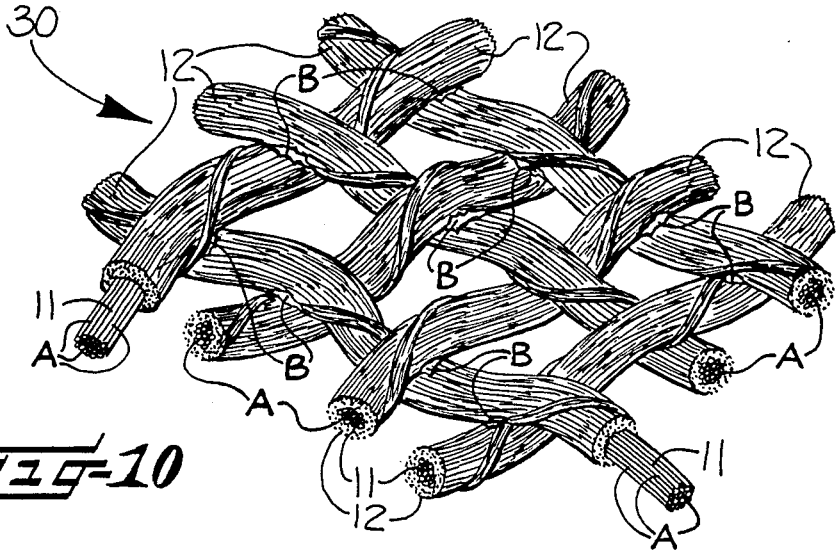
FIG. 10 is an enlarged isometric view of the treated fabric as shown in FIG. 7 and illustrating the bonding of the yarns together to provide pucker and shrink resistance thereto.

The crosslinkable composition of the present invention is generally a cured crosslinked composition comprising a first crosslinkable resin having an affinity for the fire-resistant core filaments and a second crosslinkable resin having an affinity for the shrinkable sheath fibers and also for the first crosslinkable resin. Although applicants do not wish to be bound by any theory or mechanism, it is believed that this composition prevents the puckering and shrinkage exhibited by the uncoated fabrics by disciplining and anchoring the fibers of the corespun yarns together without adversely affecting the tensile strength or flexibility of the yarns and the aesthetic appeal of the fabric. As shown in FIG. 10, the first crosslinkable resin has an affinity for the core filaments to which it crosslinks thereby bonding or anchoring the core filament of the yarn together at points A. The second crosslinkable resin has an affinity for the sheath fibers and for the first crosslinkable resin and thus, the sheath fibers of the warp yarn are bonded or anchored to the sheath fibers of the weft yarns at the crosspoints of the yarns at points B. Additionally, the fibers of the individual yarn are stabilized by the bonding or anchoring of the sheath fibers thereof with each other and with the core filaments.

SPECIFIC CURED CROSSLINKABLE COMPOSITIONS

The first crosslinkable resin preferably comprises an aqueous self-crosslinking copolymer produced by emulsion polymerization of one or more polymerizable primary monomers in the presence of a smaller proportion of at least one reactive functional latent-crosslinking comonomer. The major portion of the aqueous self-crosslinking emulsion polymer is derived from one or more ethylenically unsaturated monomers which are copolymerizable with the latent-crosslinking comonomer. Examples of suitable ethylenically unsaturated monomers include alpha olefins such as ethylene, propylene, butylene, isobutylene, diene monomers such as butadiene, chloroprene, isoprene; and aromatic and aliphatic vinyl monomers including vinyl halides such as vinyl chloride and vinylidene chloride; vinyl esters of alkanoic acids having from one to eighteen carbon atoms, such as vinyl formate, vinyl acetate, vinyl propionate, vinyl butyrate, vinyl isobutyrate, vinyl valerate, vinyl 2-ethylhexanoate, vinyl isoctanoate, vinyl monoate, vinyl decanoate, vinyl pivalate, vinyl Versatate®; vinyl esters of saturated carboxylic acids; vinyl aromatic compounds such as styrene, alpha methylstyrene, vinyl toluene, 2-bromostyrene, p-chlorostyrene; and other vinyl monomers such as acrylonitrile, methacrylonitrile, N-vinylpyrrolidone, maleate, fumarate, and itaconate esters of $C_1$ to $C_8$ alcohols. Also suitable are acrylic monomers, and in particular $C_2$–$C_{18}$ alkyl acrylates and $C_2$–$C_{18}$ alkyl methacrylates. Examples of the $C_2$–$C_{18}$ alkyl groups of the esters of acrylic and methacrylic acids which are useful in forming the copolymers of the invention include methyl, ethyl, n-butyl, i-butyl, sec-butyl, t-butyl, the various isomeric pentyl, hexyl, heptyl, and octyl (especially 2-ethylhexyl), isoformyl, lauryl, cetyl, stearyl, and like groups. Preferred ethylenically unsaturated monomers for the present invention are selected from the group consisting of aliphatic and aromatic vinyl monomers. Especially preferred as the primary monomers are unsaturated monomers selected from the group consisting of alkyl acrylates, alkyl methacrylates, acrylonitrile, acrylamide, styrene and vinyl acetate. It is particularly suitable to use mixtures of two or more ethylenically unsaturated monomers such as butyl acrylate and methyl methacrylate, butyl acrylate and styrene, butyl acrylate and acrylonitrile, butyl acrylate and vinyl acetate, ethyl acetate and styrene, and ethyl acetate and methyl methacrylate.

The latent-crosslinking monomers which are preferred for use in the present invention are characterized by being readily copolymerizable with the other monomers, and also by being capable of curing, generally in the presence of a catalyst, by means of heat or radiation. Suitable latent-crosslinking monomers may be broadly characterized as N-alkylolamides of apha, beta ethylenically unsaturated carboxylic acids having 3–10 carbons, such as N-methyol acrylamide, N-ethanol acrylamide, N-propanol acrylamide, N-methylol methacrylamide, N-ethanol methacrylamide. Also suitable are methylol maleimide, N-methylol maleamide, N-methylol maleamic acid, N-methylol maleamic acid esters, the N-alkylol amides of the vinyl aromatic acids such as N-methylol-p-vinylbenzamide and the like, N-butoxymethyl acrylamide, N-methylol allyl carbamate, glycidyl acrylate, glycidyl methacrylate, hydroxethyl acrylate, hydroxypropyl acrylate and the corresponding methacrylates. Particularly preferred as a latent-crosslinking monomer for use in the present invention is N-methylolacrylamide or mixtures of N-methylolacrylamide and acrylamide.

The latent-crosslinking monomers are present in an amount sufficient to render the copolymer insoluble upon curing and crosslinking of the composition on the yarns, but in an amount less than that which would cause any significant premature crosslinking during formulation and application. The latent-crosslinkable monomers preferably are present in an amount ranging from about 5 to 100 parts per 1000 parts of the primary monomers, by weight, and most desirably about 10 to 60 parts per 1000 parts of the primary monomers. This typically represents about 0.5 to 10 percent by weight of the copolymer.

Copolymers in accordance with the present invention also may desirably include small amounts of an acid monomer, preferably an ethylenically unsaturated carboxylic acid. Generally, any ethylenically unsaturated mono or dicarboxylic acid may be used to provide the carboxyl functionality. Examples of suitable acids include the monocarboxylic ethylenically unsaturated acids such as acrylic, vinyl acetic, crotonic, methacrylic, sorbic, tiglic, etc.; the dicarboxylic ethylenically unsaturated acids such as maleic, fumaric, itaconic, citraconic, hydromuconic, allylmolonic, etc., as well as dicarboxylic acids based on maleic acid such as mono(2-ethylhexyl) maleate, monoethylmaleate, monobutylmaleate, monomethylmaleate. Especially suitable are acid monomers selected from the group consisting of acrylic acid, methacrylic acid, crotonic acid, maleic acid, and itaconic acid. In accordance with the present invention, the presence of acid monomers in small amounts, typically ranging from about 0.1 to 10 percent by weight of the copolymer (1 to 100 parts per 1000 parts of the primary monomer), and most desirably 1 to 4 percent, acts as a functional site for crosslinking with other latent-crosslinking agents.

The copolymer also preferably includes small amounts of an active crosslinking monomer to give internal crosslinking and branching to increase the molecular weight of the copolymer. By the term "active crosslinking monomer" is meant to a polyfunctional monomer which crosslinks a polymer composition during the initial formation thereof. Subsequent drying and curing techniques are not required. Monomers of this type comprise monomers which contain two or more ethylenically unsaturated groups in one molecule capable of undergoing additional polymerization by free radical means.

Examples of suitable active crosslinking monomers include alkylene glycol diacrylates and methacrylates such as ethylene glycol diacrylate, 1,3-butylene glycol diacrylate, propylene glycol diacrylate, triethylene glycol dimethacrylate, etc., 1,3-glycerol dimethacrylate, 1,1,1-trimethylol propane dimethacrylate, 1,1,1-trimethylol ethane diacrylate, pentaerythritol trimethacrylate, 1,2,6-hexane triacrylate, sorbitol pentamethacrylate, methylene bisacrylamide, methylene bismethacrylamide, divinyl benzene, vinyl methacrylate, vinyl crotonate, vinyl acrylate, vinyl acetylene, trivinyl benzene, triallyl cyanurate, triallyl isocyanurate, divinyl acetylene, divinyl ethane, divinyl sulfide, divinyl ether, divinyl sulfone hexatriene, diallyl cyanamide, ethylene glycol divinyl ether, diallyl phthalate, divinyl dimethyl silane, glycerol trivinyl ether, divinyladipate, allyl methacrylate, allyl acrylate, diallyl maleate, diallyl fumarate, diallyl itaconate, diallyl succinate, diallyl malonate, diallyl carbonate, triallyl citrate, triallyl aconitate.

The amount of the active crosslinking monomer may typically range from about 0.01 to about 2.0 percent (0.1 to 20 parts per 1000 parts of primary monomer), preferably 0.05 to 0.6 percent by weight of the copolymer. The molecular weight of the emulsion copolymer, prior to final drying and curing, is quite high and may typically range from 100,000 to several million.

As earlier noted, the aqueous self-crosslinking copolymer is produced by emulsion copolymerization using conventional emulsion polymerization procedures and surfactants, polymerization catalysts and other additives as are conventional for such procedures. These procedures and the various surfactants, catalysts, and other additives are known in the art. The practice of emulsion polymerization is discussed in detail in D. C. Blackley, "Emulsion Polymerization", (Wiley, 1975). The size of the resulting polymer particles in the emulsion may typically range from 0.05 to 1.0 microns, preferably about 0.1 to about 0.5 microns. The polymer emulsion typically has a solids content of about 40 to 60 percent as produced. The first crosslinkable resin must be sufficiently low in viscosity to penetrate the sheath fibers and crosslink with the core fibers.

The second crosslinkable resin is selected for its affinity for both the shrinkable staple fiber sheath and should also be compatible with and have an affinity for the first crosslinkable resin. Suitable resins include those which are available commercially for the durable press treatment of textile fabrics. Typically, durable press treatments use methylol derivatives of cyclic ureas or methylol carbonates, of which the following are examples: dimethylol ethylene urea (DMEU), ethyl carbonates, and dimethylol dihydroxyethylene urea (DMDHEU). DMDHEU, sometimes called glyoxal resin is the preferred resin for this purpose. The glyoxal resin can be prepared in any known and convenient manner from glyoxal, urea, and formaldehyde, and the systems of this invention are applicable to dimethylol dihydroxyethylene urea (DMDHEU), its partially and completely methylated derivatives, and other appropriate derivatives. Also the resin composition may include a catalyst such as a magnesium chloride hexahydrate/maleic acid mixture and a surfactant such as nonylphenolethoxylate dioctylsodium sulfosuccinate.

Preferably the crosslinkable composition comprises from about 1 to 17 percent by weight of the first crosslinkable resin and from about 1 to 17 percent by weight of the second crosslinkable resin. These limits are based on the fact that too much of the first crosslinkable resin tends to increase flammability, whereas too much of the second crosslinkable resin decreases tensile strength. The crosslinkable composition may include various softeners, fillers, binders, thickners, etc. to improve the processability and to aid in applying the coating and to improve the hand of the fabric. The crosslinking reaction may be activated by heating, by radiation, or electron beam curing, and may employ catalysts or free radial initiators as is known in the art.

Figure 11:
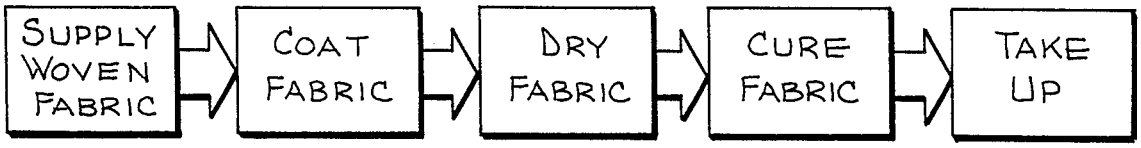
FIG. 11 is a diagrammatic representation showing the method of producing the treated fabric.

The overall process for producing the fabric is illustrated in FIG. 11. The yarns are formed and woven into a fabric. The supply of the fabric then is coated with the crosslinkable composition preferably by immersing the fabric in a pad bath of the crosslinkable composition and impregnating the fabric with about 60 to 90 percent of the composition based on the weight of the fabric. Other application techniques such as spraying, knifing, printing, foaming, vacuuming, etc. the composition onto the fabric may be used. The fabric is dried at a temperature of from about 200° to 300° F. for 1 to 4 minutes and then cured at a temperature of about 325° to 400° F. for 0.25 to 2 minutes. The fabric is taken up on a roll in preparation for end use.

EXAMPLES

The following non-limiting examples are set forth to demonstrate the comparisons between the uncoated fabrics and the coated fabrics of various weave patterns and of various yarn constructions.

EXAMPLE 1

A corespun yarn comprising a fiberglass filament core and a rayon sheath was woven to form a fabric 20 having a sateen weave. Sateen weaves, as shown in FIG. 4, are characterized by having long floats 23 of either the warp yarns (as illustrated) or the weft yarns, and by the positioning of the interlacing points 21. The uncoated fabric 20 was then washed five times resulting in the formation of undesirable loops 25 as shown in FIG. 2. Referring to FIG. 5, these loops 25, which adversely affect the aesthetic appearance and hand of the fabric, are thought to be the result of the rayon sheath shrinking and the fiberglass filaments of the core escaping therefrom to form the random loops 25.

EXAMPLE 2

A cured crosslinkable composition was prepared having the following composition:

| | parts by weight % of bath (dry) | grams/100 gram Fabric Sample |
|---|---|---|
| DMDHEU resin (57.5% solvents) | 2.125 | 1.806 |
| Magnesium chloride/maleic acid catalyst (65.8% solvents) | 0.427 | 0.363 |
| Nonylphenolethoxylate dioctylsodium sulfo-succinate surfactant (74.2% solvents) | 0.13 | 0.110 |
| Polyethylene softener (50% solvents) | 1.25 | 1.275 |
| Butyl acrylate/methyl methacrylate/n-methyol acrylamide (55% solvents) | 4.5 | 3.825 |

A fabric according to Example 1 was impregnated with about 85 percent of the above composition based on the weight of the fabric by immersion in a pad bath. The fabric was dried at 250° F. for one minute and the composition was cured by heating it to 350° F. for 30 seconds. The fabric was then washed five times. The resulting treated fabric 20, as shown in FIG. 3, did not have any loops.

EXAMPLE 3

A corespun yarn comprising a fiberglass filament core and a cotton sheath was woven to form a fabric 30 having a plain weave as shown in FIG. 8. The untreated fabric was washed five times resulting in the formation of undesirable puckers 35 of a generally herringbone pattern as illustrated in FIGS. 6 and 9. The puckers 35 are thought to be the result of interfiber slippage caused by the shrinkage of the cotton sheath.

EXAMPLE 4

A fabric according to Example 3 was impregnated with about 84 percent of the coating composition of Example 2 based on the weight of the fabric by immersion in a pad bath. The fabric was dried at 250° F. for one minute and the coating cured by heating it to 350° F. for 30 seconds. The fabric was then washed five times. As shown in FIG. 7, the crosslinkable composition substantially eliminated most of the puckers 35.

As is readily apparent, a fabric treated according to the present invention is highly resistant to puckering and shrinkage even with repeated washings. Thus, the aesthetic appeal of the fabric is maintained. Moreover, the drawbacks of forming a fabric from corespun yarns are eliminated. The treated fabric is fire-resistant, the fabric is flexible and the strength thereof is maintained.

In the drawings and specification, there have been disclosed preferred embodiments of the invention and, although specific terms are employed, they are used in a generic and descriptive sense only and not for the purpose of limitation, the scope of the invention being set forth in the following claims.

What we claim is:

1. A fabric formed of corespun yarns having a core formed of fire-resistant filaments and a sheath formed of staple fibers and a cured, crosslinked coating on said fabric and imparting pucker and shrink resistance to the fabric, said coating comprising a first crosslinkable resin having an affinity for said core filaments and a second crosslinkable resin having an affinity for said sheath fibers and for said first crosslinkable resin.

2. A fabric according to claim 1 wherein said fire-resistant core filaments comprise a fiber selected from the group consisting of glass, metal, silica, ceramic, polyaramids and polybenzimidazole fibers, and said staple fibers comprise a fiber selected from the group consisting of cotton, rayon, wool, nylon, acrylic, modacrylic, polyester, acetate fibers and blends thereof.

3. A fabric according to claim 1 wherein said crosslinked coating comprises from about 1 to 17 percent by weight of said first crosslinkable resin and from about 1 to 17 percent by weight of said second crosslinkable resin.

4. A fabric according to claim 1 wherein said first crosslinkable resin comprises an aqueous self-crosslinking copolymer produced by emulsion polymerization of one or more ethylenically unsaturated monomers in the presence of a latent-crosslinking comonomer comprising an N-alkylolamide of an alpha, beta ethylenically unsaturated carboxylic acid having 3 to 10 carbon atoms and said second crosslinkable resin is a methylol derivative resin.

5. A fabric according to claim 4 wherein said ethylenically unsaturated monomer is selected from the group consisting of alkyl acrylates, alkyl methacrylates, acrylonitrile, acrylamide, styrene and vinyl acetate.

6. A fabric according to claim 4 wherein said aqueous self-crosslinking copolymer is a butyl acrylate/methyl methacrylate/n-methylol acrylamide copolymer and said methylol derivative is dimethylol dihydroxyethylene urea.

7. A woven fabric formed of interwoven warp and weft corespun yarns having a fiberglass filament core and a staple cotton fiber sheath and a cured, crosslinked coating on the fabric and imparting pucker and shrink resistance to the fabric, said coating comprising an aqueous self-crosslinking copolymer produced by emulsion polymerization of one or more ethylenically unsaturated monomers in the presence of a latent-crosslinking comonomer comprising an N-alkylolamide of an alpha, beta ethylenically unsaturated carboxylic acid having 3 to 10 carbons atoms having an affinity for said fiberglass filament core and a methylol derivative resin having an affinity for said staple cotton fiber sheath and for said aqueous self-crosslinking copolymer.

8. A fabric according to claim 7 wherein said crosslinked coating comprises from about 1 to 17 percent by weight of said aqueous self-crosslinking copolymer and from about 1 to 17 percent by weight of said methylol derivative resin.

9. A fabric according to claim 7 wherein said ethylenically unsaturated monomer is selected from the group consisting of alkyl acrylates, alkyl methacrylates, acrylonitrile, acrylamide, styrene and vinyl acetate.

10. A fabric according to claim 7 wherein said aqueous self-crosslinking copolymer is butyl acrylate/methyl methacrylate/n-methylol acrylamide and said methylol derivative resin is dimethylol dihydroxyethylene urea.

11. A woven fabric formed of interwoven warp and weft corespun yarns having a fiberglass filament core and a rayon fiber sheath and a cured, crosslinked coating on the fabric and imparting pucker and shrink resistance to the fabric, said coating comprising an aqueous self-crosslinking copolymer produced by emulsion polymerization of one or more ethylenically unsaturated monomers in the presence of a latent-crosslinking comonomer comprising an N-alkylolamide of an alpha, beta ethylenically unsaturated carboxylic acid having 3 to 10 carbon atoms having an affinity for said fiberglass filament core and a methylol derivative resin having an affinity for said rayon fiber sheath and for said aqueous self-crosslinking copolymer.

12. A fabric according to claim 11 wherein said crosslinked coating comprises from about 1 to 17 percent by weight of said aqueous self-crosslinking copolymer and from about 1 to 17 percent by weight of said methylol derivative resin.

13. A fabric according to claim 11 wherein said ethylenically unsaturated monomer is selected from the group consisting of alkyl acrylates, alkyl methacrylates, acrylonitrile, acrylamide, styrene and vinyl acetate.

14. A fabric according to claim 11 wherein said aqueous self-crosslinking copolymer is butyl acrylate/methyl methacrylate/n-methylol acrylamide and said methylol derivative resin is dimethylol dihydroxyethylene urea.

* * * * *